US005211457A

United States Patent [19]

Lupynec

[11] Patent Number: 5,211,457

[45] Date of Patent: May 18, 1993

[54] FILE CABINET AND LATCH MECHANISM

[75] Inventor: Michael Lupynec, Toronto, Canada

[73] Assignee: Plan Hold Canada Inc., Mississauga, Canada

[21] Appl. No.: 843,174

[22] Filed: Feb. 28, 1992

[51] Int. Cl.[5] ..... A47B 63/00

[52] U.S. Cl. ..... 312/184; 312/185; 16/370

[58] Field of Search ..... 312/184, 185, 188, 190, 312/191, 183; 16/345, 370

[56] References Cited

U.S. PATENT DOCUMENTS

| | | | |
|---|---|---|---|
| 1,324,094 | 12/1919 | Rega | 16/345 |
| 1,335,415 | 3/1920 | Adams | 312/184 |
| 1,381,361 | 6/1921 | Studer | 312/185 |
| 3,704,051 | 11/1972 | Kohler | 312/184 |
| 4,139,248 | 2/1979 | Hornbacher | 312/184 |
| 4,843,680 | 7/1989 | Cress et al. | 16/370 |
| 5,081,743 | 1/1992 | Mayes | 16/370 |

*Primary Examiner*—Victor N. Sakran

[57] ABSTRACT

A cabinet is disclosed for storing planar sheets such as blueprints having a two stage door latch mechanism. The latch permits the cabinet door to be opened to a sort position wherein holding hooks supporting the hanging objects are in a closed position so that the sheets may be sorted through. The door can then be opened to a retrieval position corresponding to the holding hooks in the open position so that sheets may be added to or removed from the cabinet. In one form of the latch a slotted arm is pivotally attached to the door at one end and coupled to the back wall by a spring. A cam having an open slot is pivotally mounted to the arm at one end and while the other end is provided with a ball catch for locking the cam to the arm. A switch is constrained to move in the slots. The end of the cam slot spaced from the pivotal connection is displaced from the cam slot longitudinal axis so that when the switch contacts that end of the cam slot, the cam is pivoted downwards thereby disengaging the ball catch from the arm. The switch abuts the end of the cam slot thereby stopping the arm and holding the door in the sort position. Moving the door backward a short distance disengages the switch from the cam whereby the latter pivots downwards causing the switch to exit the cam slot whereupon the door opens to the retrieval position. As the door is returned to the closed position a ramp re-engages the cam in its original position.

12 Claims, 8 Drawing Sheets

FILE CABINET AND LATCH MECHANISM

FIELD OF THE INVENTION

The present invention relates to storage cabinets for hanging and storing large planar sheets, and more particularly to cabinet door latch mechanisms used therewith.

BACKGROUND OF THE INVENTION

There is a need for storage cabinets for storing large flexible, planar sheets such as maps, blueprints, plans and the like in such a way that the sheets may, because of their size, be sorted through without being removed from the cabinet. Thus storage cabinets used for this purpose require a cabinet door latch mechanism of the type which permits the door to be partially opened to a sort position and then further opened to a retrieval position. Current latch mechanisms are prone to jamming if both sides of the door are not opened the same amount and at the same rate.

Accordingly, it would be desirable to provide a door latch mechanism which utilizes a simple latch action.

SUMMARY OF THE INVENTION

The subject invention provides a cabinet for storing large sheets utilizing a two stage door latch mechanism which allows a cabinet door to be opened to a first sort position and a second retrieval position.

In one aspect of the invention, a cabinet is provided having a container with side walls and including a door pivotally mounted thereto along its bottom edge. A holding means is located in the container for hanging sheets thereon, the holding means operable between an open and closed position by moving the door. The cabinet includes a latch mechanism provided with a first arm member pivotally connected at a first end to the front panel and there is a resilient biasing means extending between the first arm and a point on the interior of the cabinet. The latch mechanism includes a support means operably coupled to the arm member. Also provided is a switch means which is movably mounted to a side wall and which is constrained to remain in close proximity to the first arm during movement of the first arm. The first arm is movable between a first position corresponding to the door closed and a second position corresponding to the door open. The first arm is provided with a receiving means located a predetermined distance between the first and second position for receiving the switch means, the receiving arm also includes a retaining means located adjacent the receiving means which acts to retain the switch means in the receiving means. When the switch is received by the receiving means the front panel is opened a predetermined amount wherein the holding means are in the closed position. When the switch is in the receiving means the retaining means is coupled to the switch means so that further movement of the arm member disengages the retaining means from the switch means so the switch can exit the receiving means. The support means is movable with the arm member to provide a counterbalance to the cabinet door.

In another aspect of the subject invention, there is provided a two stage latch mechanism for use in a cabinet, the cabinet having at least side walls and a front door pivotable about its bottom edge for outward movement. The latch mechanism includes a side panel member adapted to be attachable to a side wall of the cabinet on the interior thereof. A first arm member is pivotally attachable at a first end to the cabinet door at a point spaced above the bottom edge thereof and wherein movement of the door causes the arm to move. The latch includes resilient biasing means connected at one end to the first arm and connectable at the other end to a point on the interior of the cabinet. Movable support means is movably coupled to the arm member. A switch means is movably mountable to side one side wall. A cam having an elongate slot is pivotally connected at one end thereof to the arm member. The cam slot has a longitudinal axis and a first end of the slot furthest from the cam pivotal connection is transversely displaced from the slot axis and forms a receiving pocket. The cam slot has a lateral access opening located adjacent the receiving means.

The cam is provided with locking means engageable with the arm so that said cam can be locked in a position wherein the cam slot centre axis is in parallel alignment with the arm. The cam includes an elongate guide arm extending outwardly therefrom and extending adjacent the slot access opening. The switch is constrained such that the first arm member moves parallel to the switch and the switch is located in the cam slot when the cam is substantially parallel to the arm. During movement of the arm, when the switch is received in the receiving pocket the cam is pivoted downwards thereby disengaging the locking means so that the cam comes to rest on the switch and the arm is prevented from moving forward. Moving the door rearward a predetermined amount causes the arm to retrace a portion of its forward motion so that the switch moves into position adjacent the access opening enabling the cam to pivot downwards causing the switch to exit the cam slot through the access opening. The guide arm then drops onto the switch wherein the arm is freely movable. The ambit of motion of the arm is such that the switch does not extend beyond that end of the guide arm which is spaced from the cam. As the arm is moved the support means moves to counterbalance the cabinet door.

BRIEF DESCRIPTION OF THE DRAWINGS

Preferred and alternative embodiments of the subject invention will now be described by way of example only, with reference to the accompanying drawings, in which.

DETAILED DESCRIPTION OF THE PREFERRED AND ALTERNATIVE EMBODIMENTS

Figure 1:
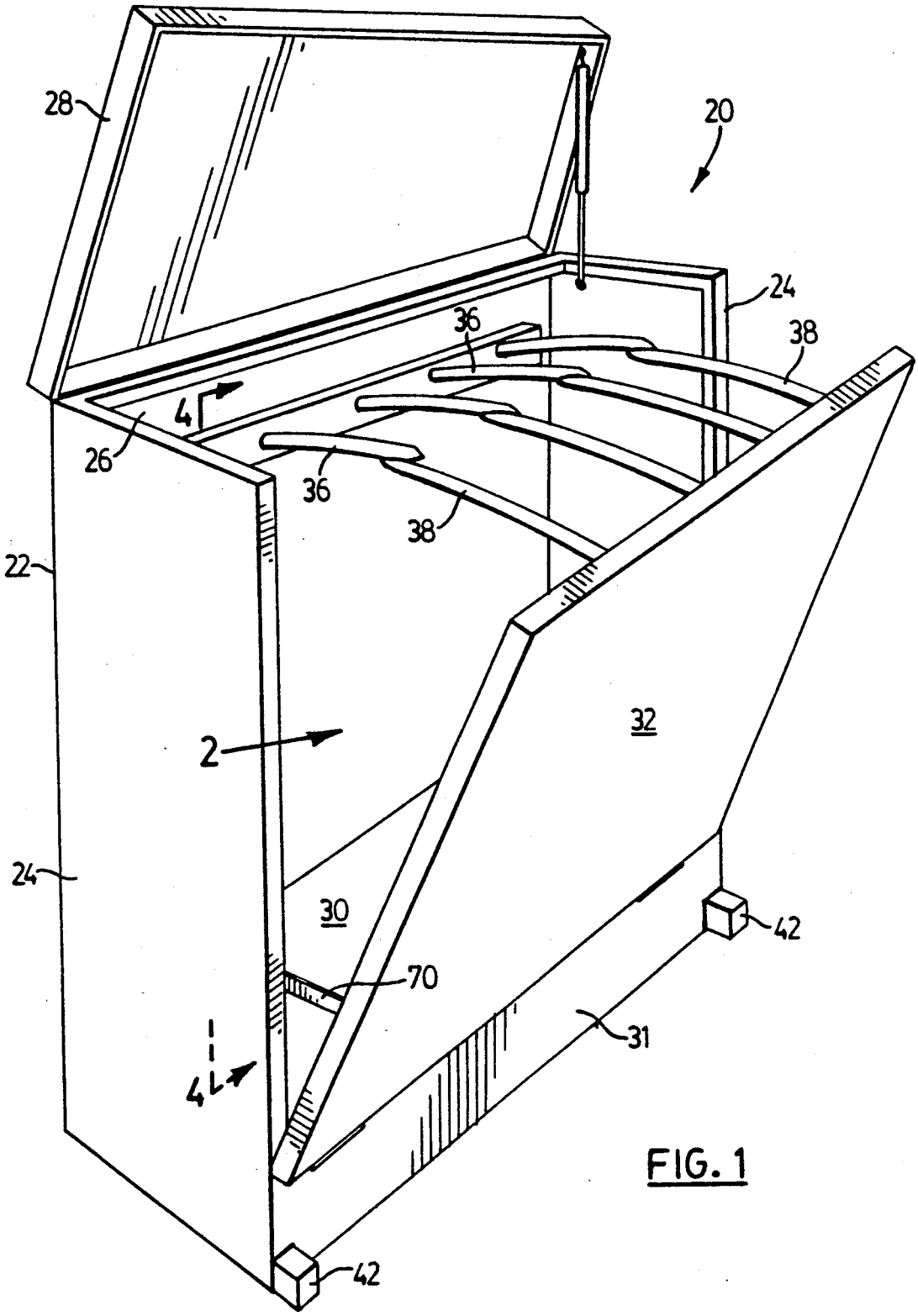
FIG. 1 is a perspective view of a storage cabinet utilizing a two stage latch mechanism of the subject invention.
Figure 2:
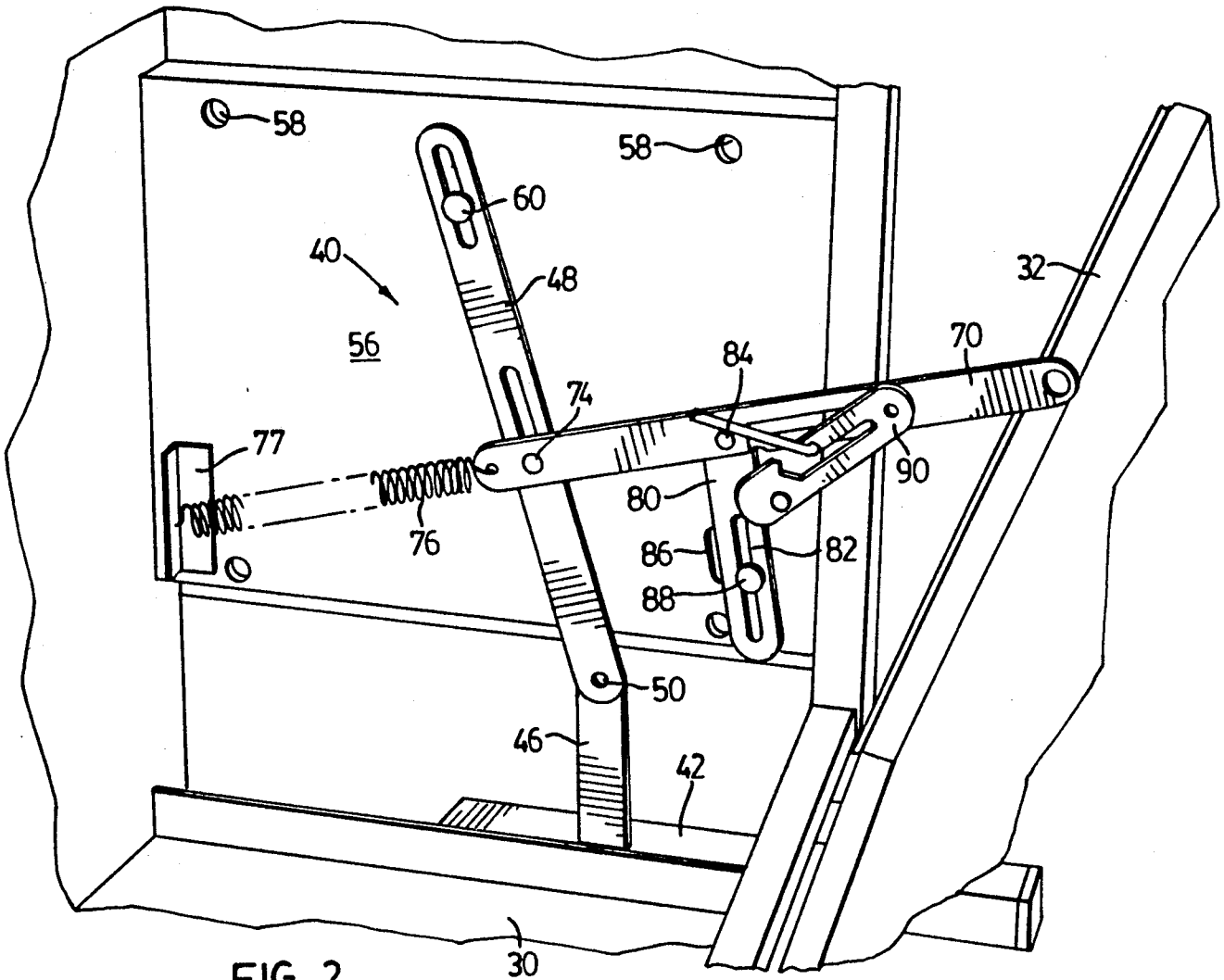
FIG. 2 is a downward perspective view of the latch mechanism forming part of the subject invention, looking in the direction of arrow 2 in FIG. 1.

In describing the structure and operation of the subject invention, reference will be made to the FIGS. wherein like numerals refer to like parts. Referring first to FIGS. 1-6, a storage cabinet for hanging and holding large sheets of drawings, maps, plans, blueprints and the like is shown generally at 20. Cabinet 20 includes a rectangular storage member 22 which comprises side walls 24, a back wall 26, a lid 28 hingedly connected to the top edge of back wall 26, a bottom panel 30, a front bottom panel 31 and a door 32 hingedly connected to the upper edge of front bottom panel 31. Cabinet 20 includes a first set of arcuate, hanging hooks 36 horizontally aligned and secured to back wall 26 and spaced from the top edge thereof and a second set of arcuate, hanging hooks 38 aligned across the top edge of door 32. Hooks 36 are in opposed registration with hooks 38, with each hook of set 36 in a matched, adjacent telescoping arrangement with a hook of set 38. Maps, blueprints and the like may be hung from hooks 36 and 38. Door 32 is movable between three positions, a first fully closed position, a second intermediate or sort position and a third fully open or retrieval position. As illustrated in FIG. 4, with door 32 in the second intermediate position or sort position, hooks 36 and 38 have overlapping portions whereby the hanging articles may be sorted through while the latter are still suspended on hooks 36 and 38. In the third position or retrieval position shown in FIG. 6, there is a gap 39 between the tips of the hooks 36 and 38 so that articles may be removed from the hooks. The means by which door 32 may be set in the intermediate sort position will now be described.

Figure 8:
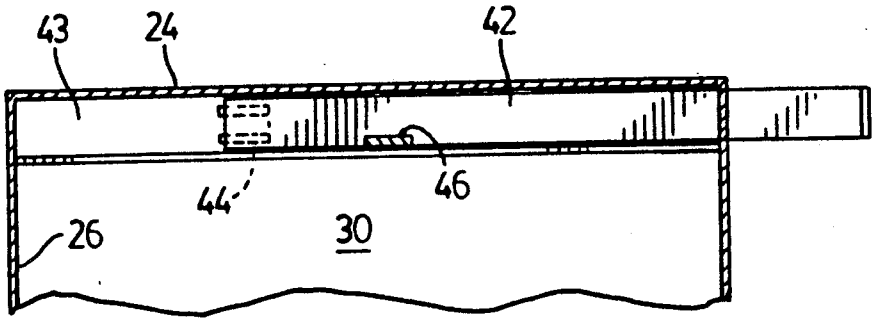
FIG. 8 is a plan view of a portion of the latch mechanism looking in the direction of arrow 8 of FIG. 4.

FIGS. 2-6 illustrate a latch mechanism of the subject invention shown generally at 40 secured to the interior of cabinet 20. While the following discussion will refer to a singular latch mechanism, it will be understood that cabinet 20 is preferably may be provided with two such mechanisms located on opposite sides of the cabinet. Latch mechanism 40 comprises a leg member 42 adapted to rest on bottom panel 30 and is provided with a pair of rollers 44 thereby allowing leg 42 to slide along panel 30. Leg 42 is provided with an elongate member 46 rigidly attached thereto and extending upwardly therefrom. FIG. 8 illustrates leg 42 constrained to move in a track 43 located on bottom panel 30 adjacent wall 24.

Latch 40 includes an arm 48 which is provided with two collinear slots 52 and 54 with slot 52 located adjacent the free end thereof. Latch mechanism 40 includes a side panel 56 which can be releasably attached to side wall 24 via known connectors shown at 58. Arm 48 is movably secured to panel 56 via a bolt or rivet 60 mounted through slot 52 and secured to panel 56 wherein rivet 60 is slidable along the slot. Arm 48 is pivotally connected to arm 46 by a pin 50.

Figure 9:
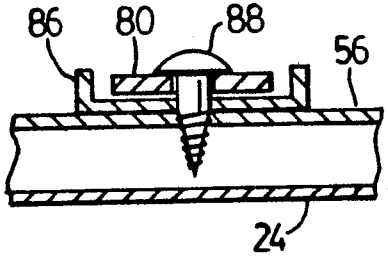
FIG. 9 is a sectional view, broken away, of a portion of the first embodiment of the latch mechanism taken along the line 9—9 of FIG. 3.

Latch mechanism 40 is provided with an elongate arm member 70 pivotally attached at a first end to front panel 32 by a pin 72 which is spaced above the bottom edge of door 32. Arm 70 is movably attached to arm 48 by a pin 74 extending through slot 54. Mechanism 40 includes a tension spring 76 connected between the end of arm 70 adjacent pin 74 and a bracket 77 fixed to panel 56 adjacent back wall 30. Arm 70 is provided with a slot 78 extending along the arm. Latch 40 includes a cam actuating arm 80 having a slot 82 and a pin 84 rigidly secured adjacent the top end thereof, pin 84 being located in slot 78. Pin 84 serves as a cam actuating switch in a manner to be described below and hereinafter will be referred to as an actuating switch. Actuating arm 80 is slidably mounted in a bracket guide 86 by a pin 88 mounted through slot 82. Bracket 86 is mounted to panel 56. Details of bracket guide 86 are shown in FIG. 9.

Latch 40 includes a cam arm 90 having a slot 92 extending along the cam arm. Arm 90 is pivotally connected to arm 70 by a pin 94 so that slots 78 and 92 may be by pivoting cam 90 until said slots are lined up. Cam 90 includes an actuating pin retrieval ramp 96 extending outwardly from the cam body thereby defining an access entrance 98 to cam slot 92.

Figure 7:
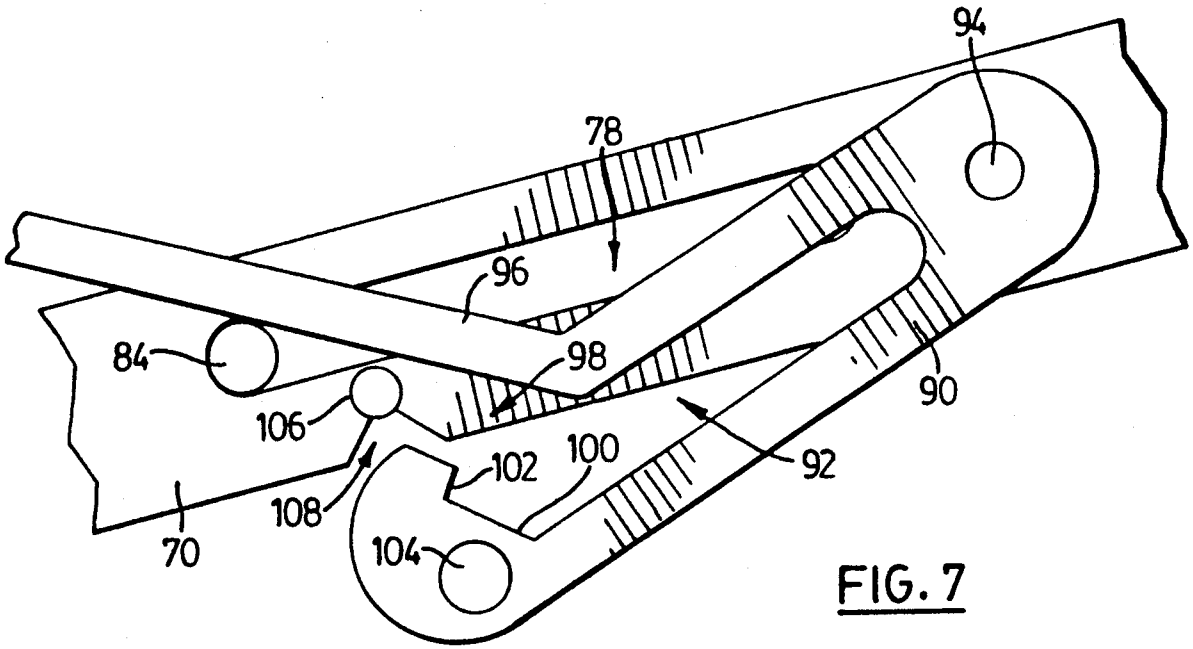
FIG. 7 is a blow-up of a portion of the latch mechanism of FIG. 6.
Figure 10:
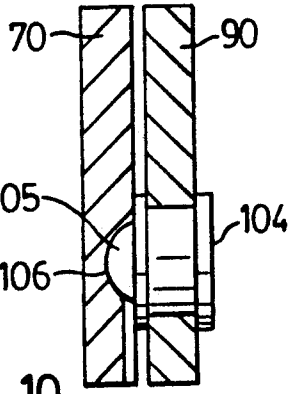
FIG. 10 is a sectional view of a portion of the first embodiment of the latch mechanism taken along the line 10—10 of FIG. 3.

Referring to FIG. 7, the end portion of slot 92 adjacent access entrance 98 has an asymmetric V-shape having a first surface 100 and a second surface 102. The apex of the V-shaped end portion is displaced transversely from the longitudinal slot axis and forms a receiving pocket for receiving switch 84 therein. Cam 90 is provided with a known spring actuated ball catch 104 mounted therein and situated adjacent the V-shaped end portion of slot 92. Arm 70 is provided with an indentation 106 and a cut-out portion 108 located below indentation 106. Details of ball catch 104 are displayed in FIG. 10 wherein a ball 105 forming part of catch 104 nests within indentation 106 under spring tension when cam arm 90 is aligned with arm 70 so that slots 78 and 92 are aligned.

The operation of latch mechanism 40 in combination with the rest of storage cabinet 20 will now be described with particular reference to FIGS. 3-6.

Figure 3:
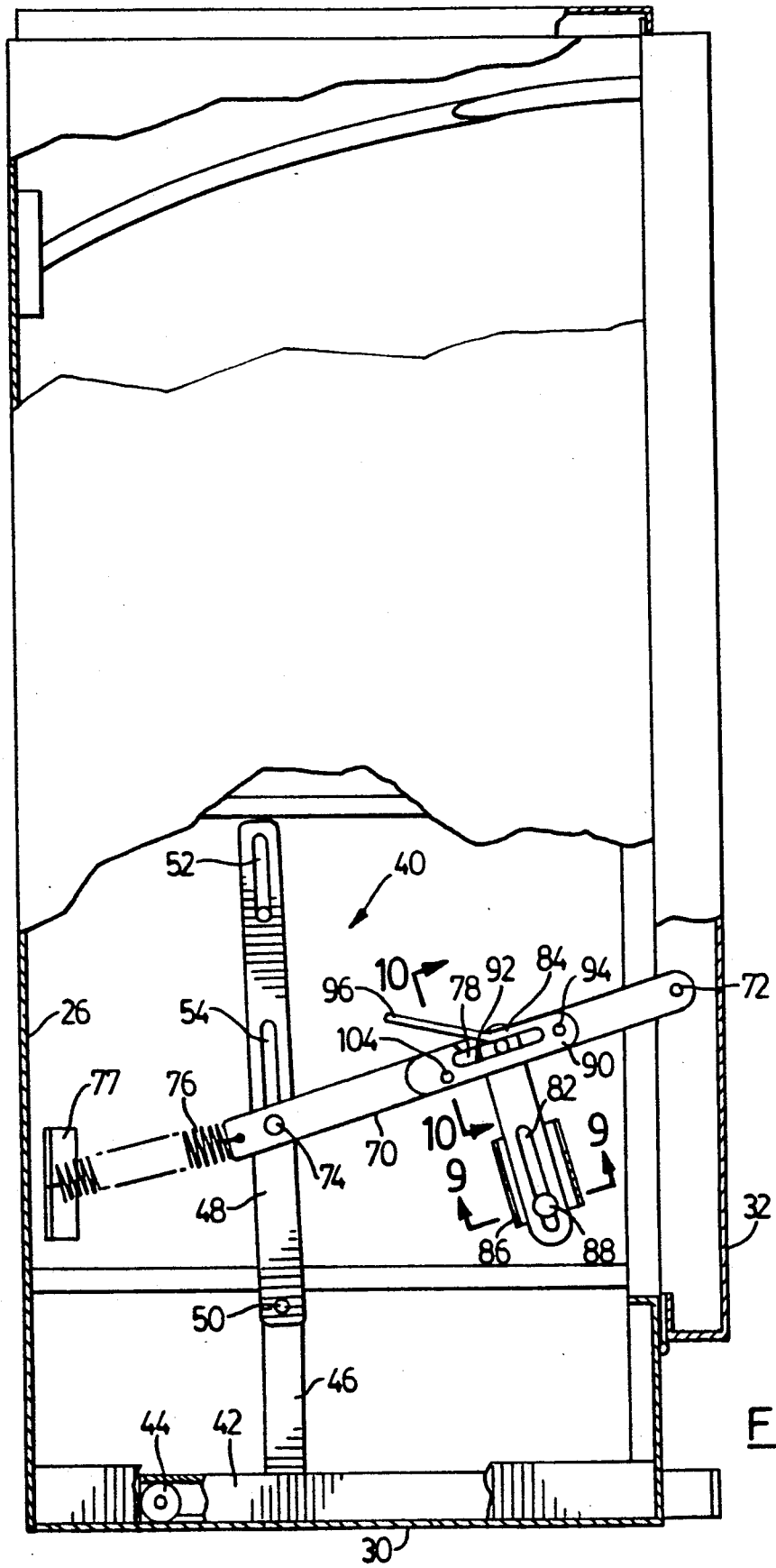
FIG. 3 is a view of the latch mechanism of FIG. 2 in the fully closed position.
Figure 4:
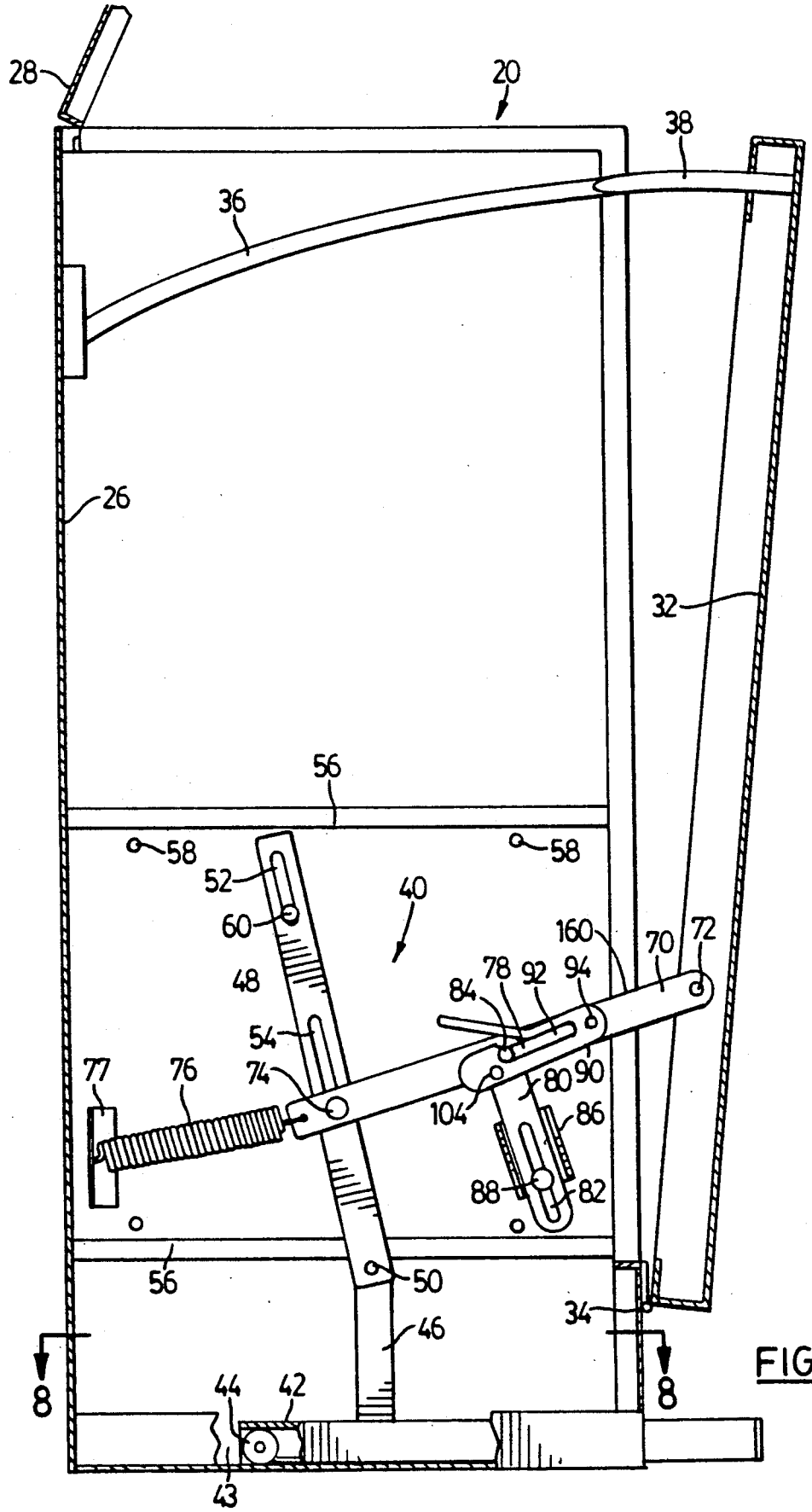
FIG. 4 is a view similar to FIG. 3 with the cabinet door and latch mechanism in the first intermediate open or sort position.

In the closed position illustrated in FIG. 3, cam 90 is aligned with arm 70 so that slots 78 and 92 are parallel and cam 90 is locked in this position since ball 105 is nesting within indentation 106. Actuating switch 84 is located at the forward ends of slots 78 and 92 and leg 42 is in the fully retracted position. As door 32 is pulled outwardly at the top, arm 70 is pulled forward extending spring 76 and pulling the lower portion of arm 48 forward and causing arm 48 to pivot about pin 50. As the lower portion of arm 48 is pulled forward leg 42 is pulled forward in track 43 and protrudes out in front of cabinet 20 thereby acting as a counterforce to open door 32, see FIG. 6. As arm 70 is pulled forward actuator switch 84 slides within slots 78 and 92, and because the front portion of arm 70 drops by pivoting about pin 74, pin bracket 80 slides downwardly with respect to guide bracket 86 and pin 88. When arm 70 has moved a predetermined distance, switch 84 makes contact with edge 100 of the V-shaped cam slot end portion thereby forcing the free end of cam 90 to drop as ball 105 pops out of indentation 106 and is located in cutout portion 108. When switch 84 makes contact with both edges 100 and 102 at the end of slot 92 it becomes lodged in the receiving pocket thus preventing any further forward movement of arm 70 while simultaneously preventing the free end of cam 90 dropping any further. Door 32 is now locked in a first intermediate open position as illustrated in FIG. 4 wherein the end portions of hanging hooks 36 and 38 are still adjacent and overlapping. This corresponds to the sort position wherein the hanging articles may be sorted through.

Figure 5:
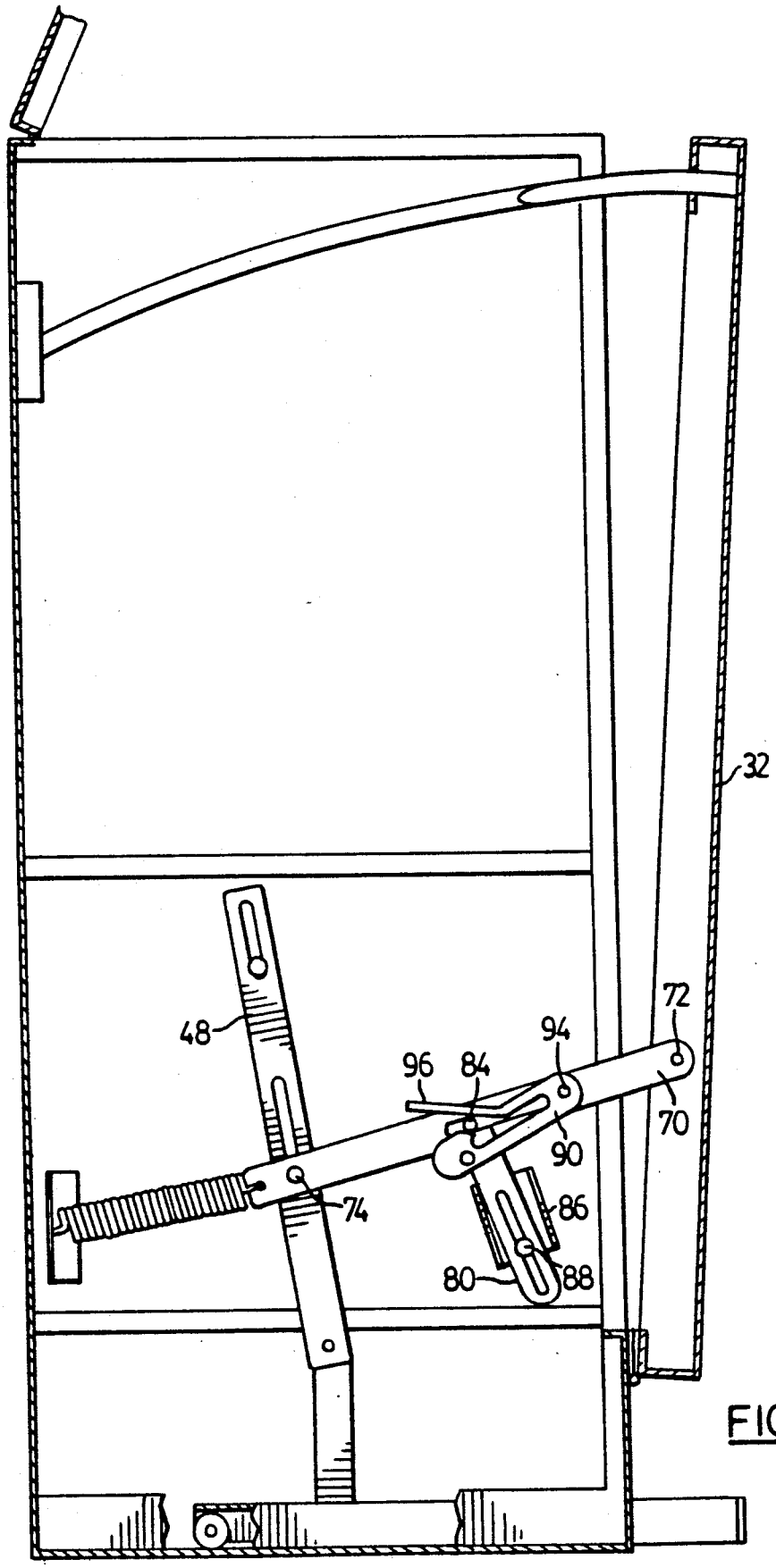
FIG. 5 is a view similar to FIG. 4 but with the door pushed towards a closed position preparatory to allowing the door to be opened to the retrieval position.
Figure 6:
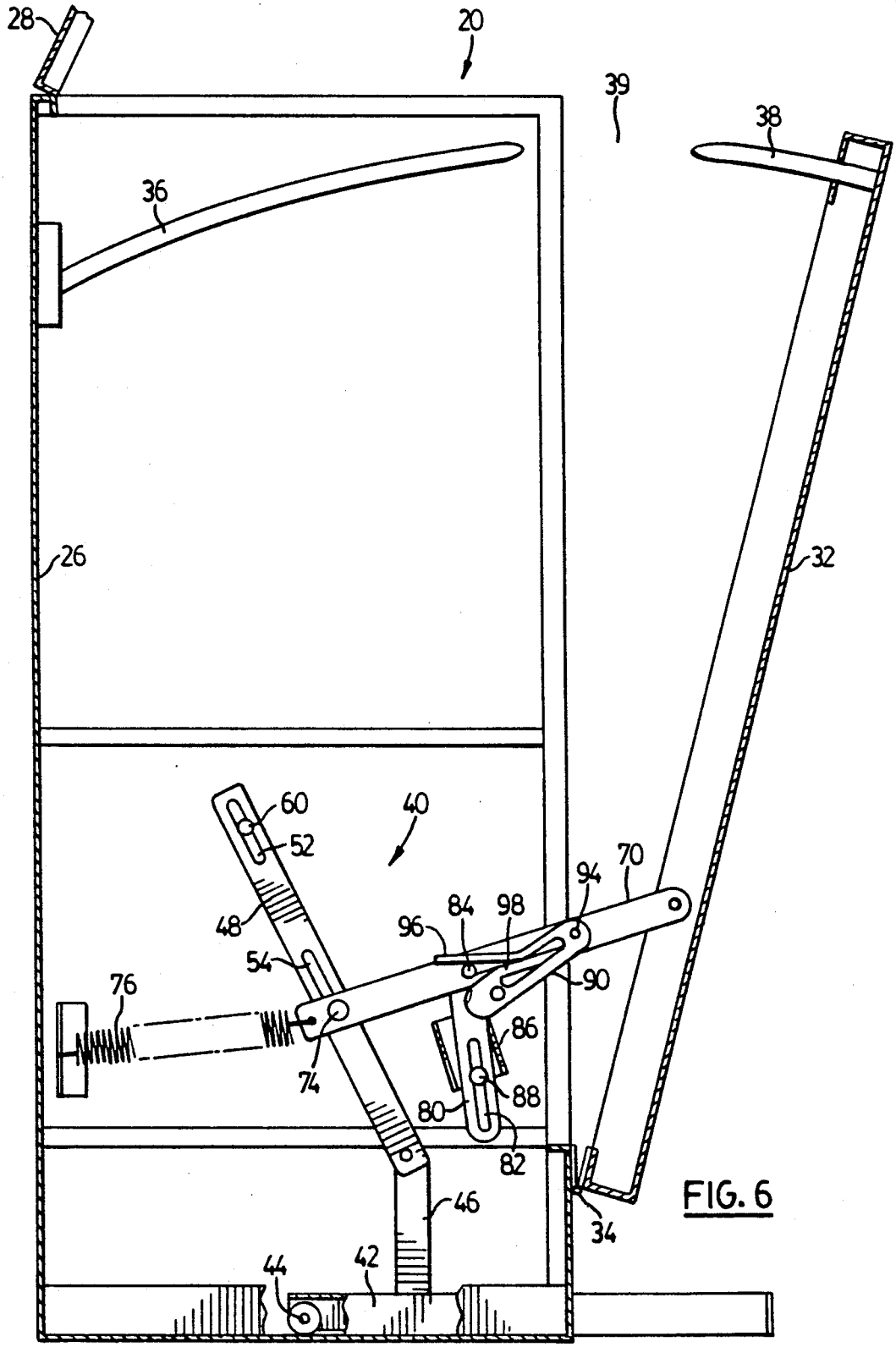
FIG. 6 is a view similar to FIG. 4 but with the door and latch mechanism in the fully open or retrieval position.

To move door 32 to the fully open position the latter is pushed backwards slightly until cam 90 has moved a distance sufficient so that switch 84 is clear of the V-shaped end portion of slot 92, as seen in FIG. 5. At this point cam 90 drops downwards about pin 94 until retrieval ramp 96 drops onto pin 84 at which point the latter has exited slot 92 through access opening 98. Door 32 is then pulled forward again until switch 84 reaches the end of slot 78. In this position door 32 is in the fully open or retrieval position whereupon the ends of the two sets of hooks 36 and 38 are spaced apart so that articles may be removed therefrom or added thereto, see FIG. 6. During the outward movement of door 32, leg 42 also continues to move outwardly due to the pulling action of arm 48. When door 32 is fully open in the retrieval position leg 42 is fully extended.

To close cabinet 20, door 32 is pushed rearwardly whereupon pin bracket 80, arm 70, leg 42 and arm 48 retrace the opening pathway. As arm 70 is pushed rearwardly, retrieval ramp 96 is supported by switch 84 which forces cam 90 to pivot back to its closed position at which point ball 105 pops back into and nests within indentation 106.

It will be understood that the purpose of leg 42, member 46 and arm 48 is in part to provide a support means for arm 70 while spring 76 provides a flexible coupling between arm 70 and cabinet 20 to allow controlled motion of door 32 and to bias the latter in the closed position.

Those skilled in the art will appreciate that alternative mechanisms to latch 40 embodying the subject invention may be utilized to provide a latch which opens to a first intermediate position and a second fully open position. For example, the latch mechanism of FIG. 4 could be modified so that switch 84 is constrained to travel along upper edge 160 of arm 70 instead of within slot 78. Cam 90 would then be modified so that cam slot 92 is positioned so that switch 84 is located therein when slot 92 is parallel to arm 70.

While the two stage latch mechanism disclose herein has been illustrated and described in combination with a storage cabinet, it will be appreciated that any cabinet having a bottom hinged front door may be readily modified to receive the disclosed latch mechanism so long as side panel 56 can be secured to the side wall of the cabinet.

While the present invention has been described and illustrated with respect to the preferred and alternative embodiments, it will be appreciated that numerous variations of these embodiments may be made without departing from the scope of the invention, which is defined in the appended claims.

I claim:

1. A cabinet for hanging and storing large sheets, comprising:

a) a container having at least two side walls, and including a door pivotal about its bottom edge for outward opening;

b) holding means located in the container for hanging articles thereon, said holding means operable between an open and closed position by moving the door; and c) latch means including a first arm member pivotally attached at a first end to the door so that movement of said door causes the arm to move, resilient biasing means extending between the first arm member and a point on the interior of the container means for resiliently biasing the door in the closed position, movable support means movably coupled to the arm member, a switch means movably mounted on a side wall, the switch means constrained to remain in close proximity to said first arm during movement of said first arm, the first arm movable between a first position wherein the door is closed and a second position wherein the door is open, the first arm member including an elongate cam member pivotally connected at one end thereof to the first arm member, the cam member being provided with an elongate slot having a longitudinal axis, the cam slot having a lateral access opening, the end of said elongate slot furthest from said cam pivotal connection being transversely displaced off the slot centre axis and forming a pocket receiving means for receiving said switch means, the lateral access opening being adjacent said pocket receiving means, the cam provided with cam locking means engageable with the first arm member so that said cam can be locked in a position wherein the cam slot longitudinal axis is in parallel alignment with said first arm member, the cam member provided with an elongate guide arm extending laterally therefrom and extending adjacent the slot access opening, the switch means constrained such that the first arm member moves parallel to said switch and the switch being located in the cam slot when the cam member is substantially aligned with the first arm member, wherein by the pocket receiving means receiving the switch the cam member is pivoted downwards thereby being displaced from this locked position so that the cam is resting on the switch, and wherein moving the arm rearward a predetermined amount causes the first arm member to retrace a portion of its forward motion whereby the switch is retracted from the pocket receiving means and the cam pivots downwards wherein the switch exits the cam slot through the access opening, the guide arm dropping onto the switch wherein the first arm member is freely movable, the ambit of motion of the first arm member being such that the switch does not extend beyond the free end of the guide arm which is spaced from the cam member.

2. The cabinet according to claim 1 wherein the first arm member is provided with an art slot, the switch being located in said arm slot, the cam locking means being engageable with said first arm member when the cam slot is in parallel alignment with the arm slot, wherein the end of the cam slot which forms the pocket receiving means is spaced from the corresponding end portion of the arm slot and is adjacent a portion of the arm slot when the slots are aligned.

3. The cabinet according to claim 2 wherein the support means includes a leg member slidably moveable along the bottom panel, a second arm movably coupled at one end to said cabinet wall and pivotally coupled at the other end to the leg member, the first arm movably coupled at a position adjacent the second end thereof to the second arm, the biasing means extending between the second end thereof and a point on the back wall, wherein movement of the arm forward causes a corresponding forward movement of the leg member so that the leg protrudes substantially in front of the cabinet under the open door.

4. The cabinet according to claim 3 wherein the leg member includes a connector arm extending upwardly therefrom, the second arm pivotally coupled to the end of said connector arm spaced from the leg.

5. The cabinet according to claim 1 wherein the latch means is a first latch means mounted adjacent a first cabinet side wall, and including a second latch means substantially the same as the first latch means mounted adjacent the second cabinet side wall.

6. The cabinet according to claim 1 wherein the cabinet includes a back wall, a bottom panel, and a lid hingedly connected to said back wall.

7. The cabinet according to claim 6 wherein the holding means includes a first set of arcuate hooks horizontally aligned and attached to said back wall, and including a second set of arcuate hooks horizontally aligned along said door in opposed relation to said hooks located on said back wall, the hooks on said back wall in telescoping adjacent relationship to the hooks on the door wherein in the closed position the opposed hooks are overlapping and in the open position there is a gap located between the end portions of hooks in the first and second sets of hooks.

8. A two stage latch mechanism for use in a cabinet, the cabinet having at least side walls and including a front door pivotable about its bottom edge for outward opening, comprising:

a first arm member pivotally attachable at a first end to a cabinet door at a point spaced from its lower edge so that movement of the door causes the arm to move, resilient biasing means connected at one end to the first arm and connectable at the other end to a point on the interior of the cabinet, movable support means operably coupled to the arm member, a switch means movably mountable to one side wall, an elongate cam member pivotally connected at one end thereof to the arm member, the cam provided with an elongate slot extending therealong, the cam slot having a lateral access opening, a first end of said slot furthest from said cam pivotal connection being transversely displaced from the slot longitudinal axis and forming a receiving pocket for said switch, the access opening being adjacent said receiving pocket, the cam provided with locking means engageable with the arm so that said cam can be locked in a position wherein the cam slot centre axis is in parallel alignment with said arm, the cam provided with an elongate guide arm extending laterally therefrom and adjacent the slot access opening, the switch constrained such that the first arm member moves parallel to said switch and the switch being located in the cam slot when the cam is substantially parallel to the arm, wherein when the switch is received by said first end of the cam slot the cam is pivoted downwards thereby disengaging the locking means so that the cam is resting on the switch, and wherein moving the arm rearward a predetermined amount causes the arm to retrace a portion of its forward motion whereby the switch comes into adjacent relation with the access opening thereby enabling the cam to pivot downwards causing the switch to exit the cam slot through the access opening, the guide arm dropping onto the switch wherein the arm is freely movable, the ambit of motion of the arm being such that the switch does not extend beyond that end of the guide arm which is spaced from the cam, and wherein the movable support means is movable with the first arm member to provide counterbalance support to the door.

9. The latch mechanism according to claim 8 including a side panel member attachable to an interior side wall, the switch means movably mounted to said panel member.

10. The latch mechanism according to claim 9 wherein the leg member includes a connector arm extending upwardly therefrom, the second arm pivotally coupled to the end of said connector arm spaced from the leg.

11. The latch mechanism according to claim 8 wherein the arm is provided with a longitudinal arm slot, the switch being located in said slot, the cam locking mechanism being engageable with said arm when the cam slot is in parallel alignment with the arm slot, wherein when said slots are parallel said first end of the cam slot is spaced from the corresponding end portion of the arm slot and is adjacent a portion of the arm slot.

12. The latch mechanism according to claim 8 wherein the support means includes a leg member slidably moveable along the bottom panel, a second arm movably coupled at one end to said cabinet wall and pivotally coupled at the other end to the leg member, the first arm movably coupled at a position adjacent the second end thereof to the second arm, the biasing means extending between the second end thereof and a point on the back wall, wherein movement of the arm forward causes a corresponding forward movement of the leg member so that the leg protrudes substantially in front of the cabinet under the open door.

* * * * *